US006162109A

United States Patent [19]

Baier

[11] Patent Number: 6,162,109

[45] Date of Patent: Dec. 19, 2000

[54] YO-YO HAVING ADJUSTABLE STRING GAP

[75] Inventor: Harry Baier, Gutach, Germany

[73] Assignee: Flambeau Products Company, Middlefield, Ohio

[21] Appl. No.: 09/430,458

[22] Filed: Oct. 29, 1999

[51] Int. Cl.[7] ..... A63H 1/30

[52] U.S. Cl. ..... 446/250; 446/247

[58] Field of Search ..... 446/247, 248, 446/250, 236, 256

[56] References Cited

U.S. PATENT DOCUMENTS 3,936,974 2/1976 House ..... 446/250
5,017,172 5/1991 Seifert ..... 446/250
5,389,029 2/1995 McAvoy, Jr. ..... 446/250
5,951,361 9/1999 Van Dan Elzen et al. ..... 446/250
5,984,759 11/1999 O'Sullivan ..... 446/250

*Primary Examiner*—Sam Rimell
*Attorney, Agent, or Firm*—Michael Best & Friedrich LLP

[57] ABSTRACT

A yo-yo includes a string gap in-between first and second side members. The string gap setting is adjustable by relative rotation of the first and second side members. The yo-yo includes an indexing mechanism for resiliently maintaining the string gap setting at discrete increments. The yo-yo axle includes a bore permitting the application of lubricant to the yo-yo bearing without changing the string gap setting.

11 Claims, 3 Drawing Sheets

YO-YO HAVING ADJUSTABLE STRING GAP

FIELD OF THE INVENTION

The invention relates to yo-yos, and particularly to yo-yos having adjustable string gaps.

BACKGROUND

Many yo-yo tricks require the yo-yo to spin freely at the end of the string without climbing up the string. A yo-yo spinning freely at the end of the string is commonly said to "sleep" or "dwell." Ideally, a player will cause the yo-yo to sleep, and perform the desired trick while the yo-yo is spinning. After the trick has been executed, the player tugs on the string and the yo-yo climbs up the string again (referred to herein as "waking up" the yo-yo). While it becomes increasingly easier to make the yo-yo sleep as the friction forces between the string and yo-yo axle are decreased, it also becomes increasingly more difficult to wake up the yo-yo and cause it to climb up the string from a sleeping condition. Thus, the friction forces between the string and axle must be adjusted to accommodate the skill level of the player and the types of tricks performed.

The string gap is the distance between the two yo-yo body halves. A decrease in string gap will typically make winding the string around the axle easier, and will also make waking up the yo-yo easier. In known yo-yos, the string gap may be adjusted by rotating the body halves with respect to each other, as a threaded connection between the axle and one of the body halves causes the body halves to be drawn together or moved apart. Setting the string gap to the proper setting often requires trial and error on the part of the player. Many players have their own preferred string gap setting.

It is also known to include a bearing on the axle and to interconnect the string to the bearing to reduce friction forces between the axle and the string. Many bearings create a state of very low friction around the axle, making it difficult to wake up the yo-yo. Small amounts of heavy lubricant (e.g., grease, petroleum jelly, etc.) having relatively high viscosity are often introduced around the bearing to increase the friction of the bearing to a level at which the yo-yo can sleep for a time sufficient to execute a trick, but at which the yo-yo is still relatively easily woken up. By balancing the string gap setting and the amount of lubricant around the bearing, a player can optimize the ease with which the yo-yo is put to sleep and woken up.

SUMMARY

Known yo-yos typically require either that the yo-yo be taken apart or that the string gap be increased to a very wide setting to apply lubricant to the bearing.

The initial lubricant applied to the bearing may wear away as the yo-yo is used, requiring the reapplication of lubricant. Thus, a player who has set a string gap to a preferred setting will usually have to take the yo-yo apart or change the string gap setting in order to relubricate the bearing. After reapplication of the lubrication, the player usually has to reset the string gap to the preferred setting through trial and error. It would therefore be desirable to provide a yo-yo that enables a desired string gap setting to be maintained while lubricant is applied and reapplied to the bearing.

It is also possible for the string gap in known yo-yos to drift during use, so that the string gap gradually becomes either larger or smaller. Handling of the yo-yo and centrifugal forces on the yo-yo during operation may cause some rotation of the body halves with respect to each other, causing string gap drift. Such string gap drift will change the spin characteristics of the yo-yo, and may require the player to reset the string gap setting repeatedly. It would therefore be desirable to provide a yo-yo that has an adjustable string gap, and that resists string gap drift.

The present invention provides a yo-yo having an indexing mechanism for adjusting the string gap setting in discrete increments. Preferably, the indexing mechanism resiliently holds the string gap at a selected string gap setting. This substantially prevents string gap drift, and permits easy and accurate adjustment of the string gap setting. Preferably, the indexing mechanism includes an index base having first and second sets of detents, a pin holder having a plurality of insertable members aligned with the first set of detents, and a biasing member biasing the insertable members into the first set of detents to resiliently hold the side members at a first string gap setting. Preferably, the insertable members are removable from the first set of detents against the biasing force of the biasing member, and movable into alignment with the second set of detents such that the biasing member biases the insertable members toward the second set of detents to resiliently hold the side members at a second string gap setting. The insertable members may be substantially any shape, including pins and balls, provided a portion of the insertable members is insertable at least partially into the detents.

The present invention also provides a yo-yo including an axle having a bore extending substantially along the longitudinal axis of the axle. A hole is provided in an outer surface of the axle, and extends substantially transverse to the longitudinal axis of the axle to intersect and communicate with the bore. The bore and hole provide a lubricant flow path for lubricant injected into the end of the axle through the bore. The hole is positioned near the yo-yo's bearing such that lubricant is provided to the bearing through the bore and hole. Preferably, the bore is positioned such that lubricant may be injected into the bore without changing the string gap setting.

It is an advantage of the present invention to provide a yo-yo having an indexing mechanism for adjusting the string gap setting at discrete increments.

It is a further advantage of the present invention to provide an indexing mechanism that resiliently holds the sides of the yo-yo at a selected string gap setting.

It is a further advantage of the present invention to provide a yo-yo having a lubrication system that permits lubrication of the bearing without changing the string gap setting.

Other features and advantages of the invention will become apparent to those skilled in the art upon review of the following detailed description, claims, and drawings.

Figure 4:
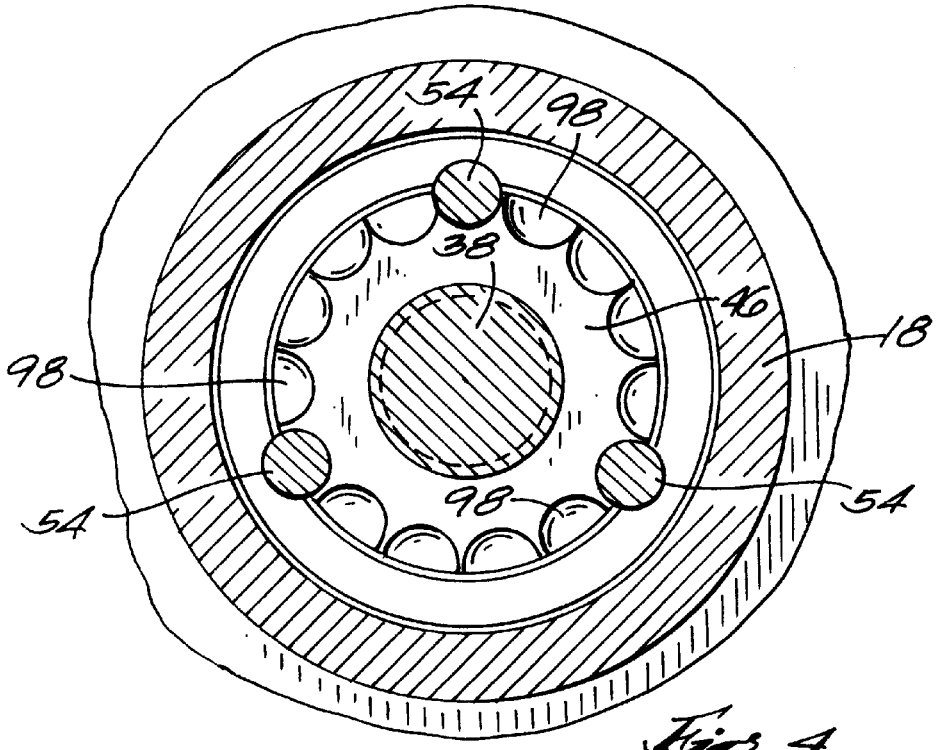
FIG. 4 is a cross-section view taken along line 4—4 in FIG. 3.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order.

DETAILED DESCRIPTION

Figure 1:
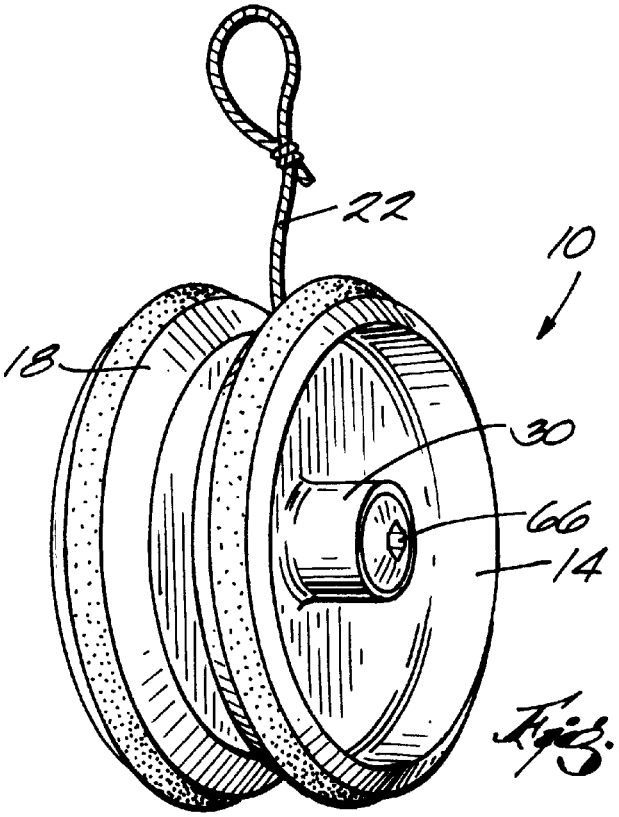
FIG. 1 is a perspective view of a yo-yo embodying the invention.

FIG. 1 illustrates a yo-yo 10 including first and second side members 14, 18. The illustrated yo-yo 10 is an Imperial or tournament style yo-yo, but the invention may alternatively be embodied in a yo-yo of another style, such as a Butterfly style in which the side members 14, 18 are inverted and flare outwardly.

A string 22 is interconnected with the yo-yo 10 in-between the side members 14, 18. The side members 14, 18 include hubs 26, 30, respectively.

Figure 2:
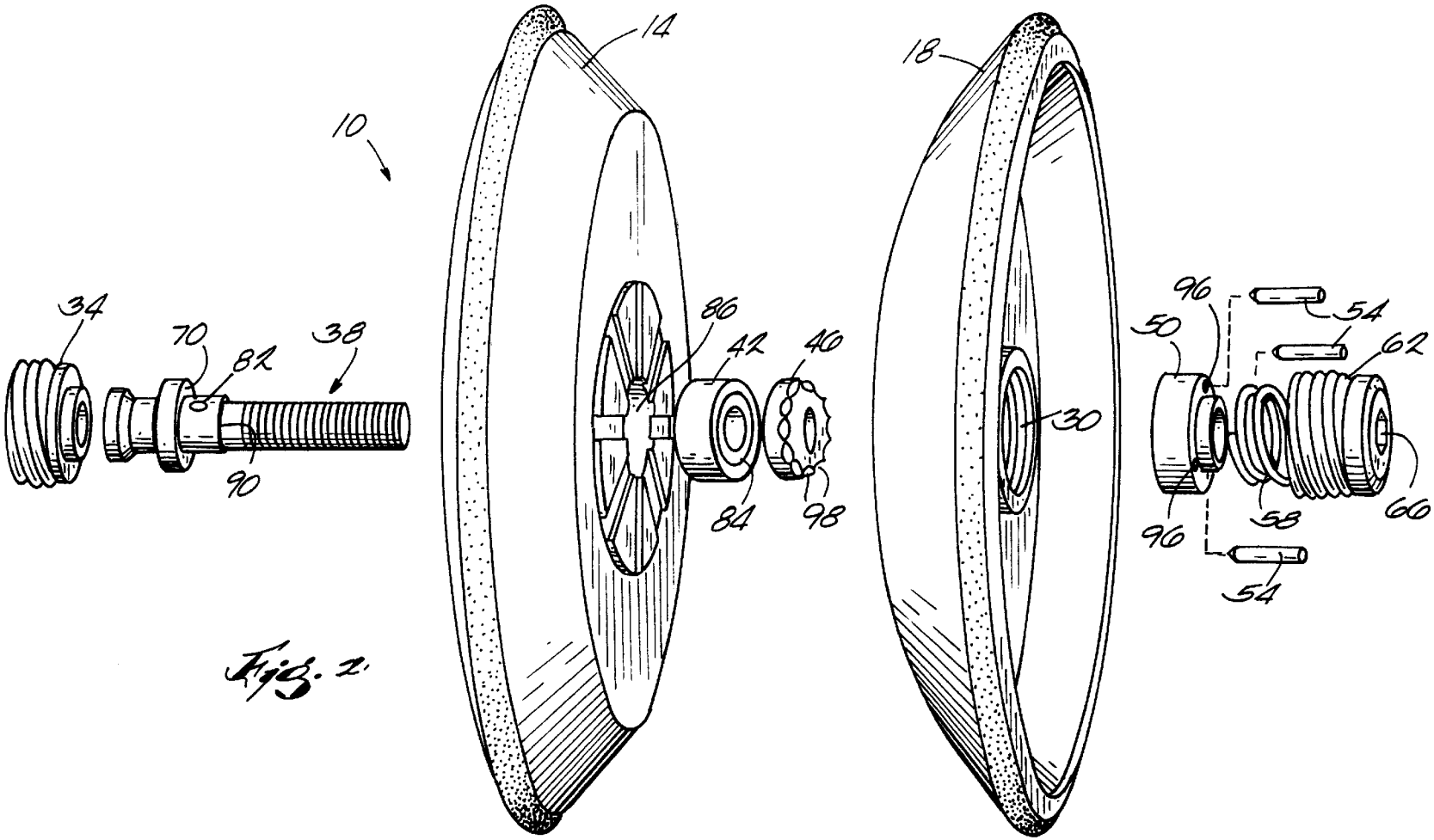
FIG. 2 is an enlarged exploded view of the yo-yo of FIG. 1.

FIG. 2 illustrates the parts of the yo-yo 10, including a first end cap 34, an axle 38, a bearing 42, an index base 46, a pin collar or holder 50, a plurality of insertable members 54, a biasing member 58, and a second end cap 62. The first and second end caps 34, 62 are threaded and are adapted to be threaded into the hubs 26, 30 of the respective first and second side members 14, 18. The illustrated end caps 34, 62 each include an aperture 66 to accommodate a hex wrench. Alternatively, the end caps 34, 62 may include appropriate slots or apertures for other tools. As discussed below, the aperture 66 in the first end cap 34 also accommodates a lubricant injector.

Figure 3:
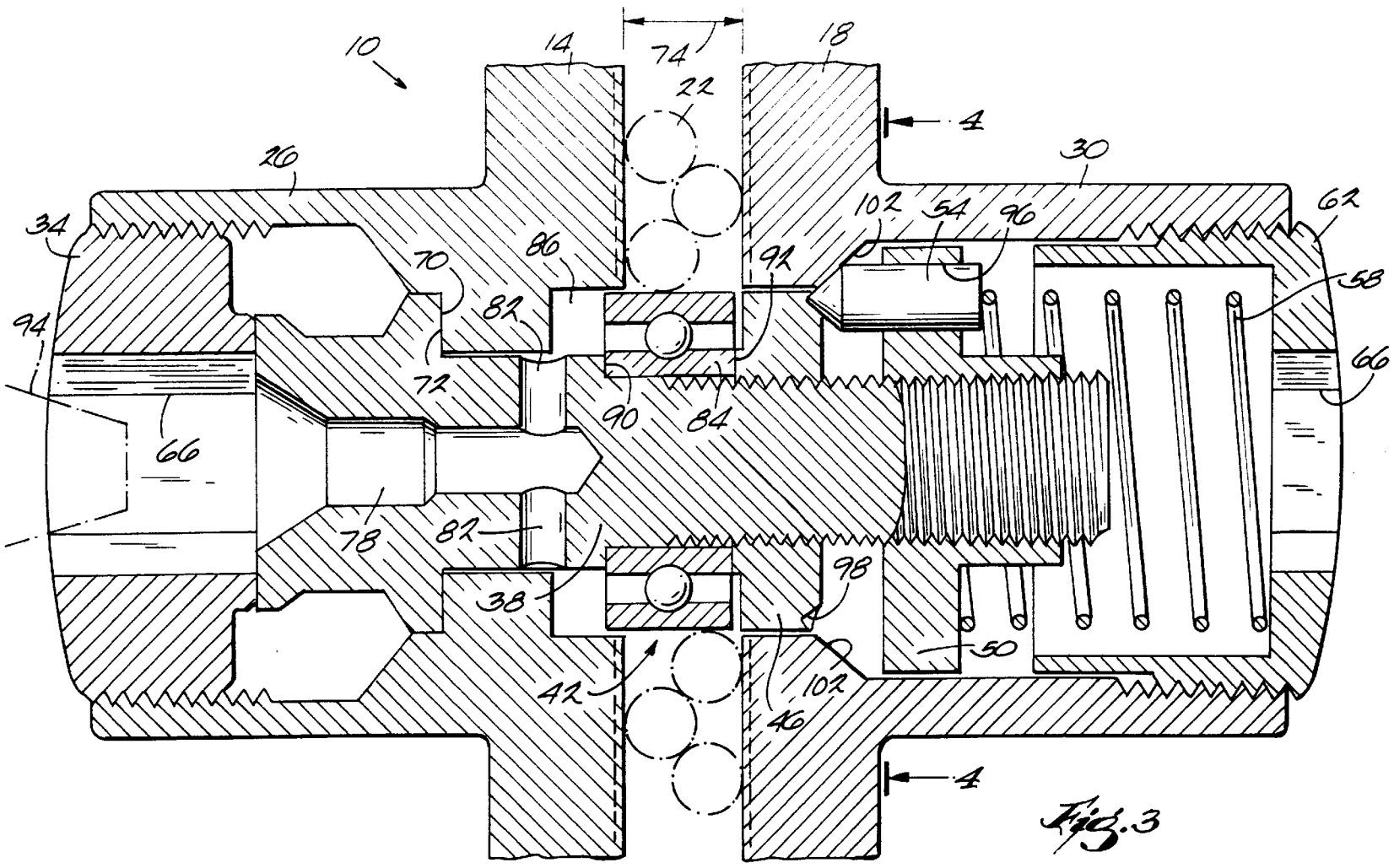
FIG. 3 is an enlarged partial cross-section view of the yo-yo of FIG. 1.

Referring now to FIG. 3, the axle 38 extends through the hubs 26, 30 in the first and second side members 14, 18, and includes an axle shoulder 70 (also shown in FIG. 2) that abuts a shoulder 72 of the first side member 14. The axle shoulder 70 is held securely against the shoulder 72 of the first side member 14 by tightly threading the first end cap 34 into the first side hub 26. The first end cap 34 abuts the end of the axle 38 and drives the axle shoulder 70 against the shoulder 72 of the first side member 14. Assuming the first end cap 34 is sufficiently tightly threaded into the first side hub 26, the normal force between the axle shoulder 70 and the shoulder 72 of the first side member 14 causes the axle 38 and first side member 14 to be substantially rotatably fixed with respect to one another (i.e., the axle 38 and first side member 14 are substantially prevented from rotating with respect to one another).

The opposite end of the axle 38 is threadedly received in the pin holder 50. As described in more detail below, the pin holder 50 is substantially rotatably fixed with respect to the second side member 18 (i.e., the pin holder 50 and second side member 18 are substantially prevented from rotating with respect to one another). The distance 74 between the side members 14, 18 is referred to as the "string gap." Because the first side member 14 is rotatably fixed with respect to the axle 38, and the second side member 18 is rotatably fixed with respect to the pin holder 50 into which the axle 38 is threaded, the string gap 74 may be adjusted by relative rotation between the first and second side members 14, 18.

The axle 38 includes a bore 78 extending into one end thereof substantially along the longitudinal axis of the axle 38. The illustrated bore 78 aligns with the aperture 66 in the first end cap 34. The axle 38 also includes one or more holes 82 extending substantially transverse to the longitudinal axis of the axle 38. The holes 82 extend from the outer surface of the axle 38 and intersect and communicate with the bore 78. The first side member 14 includes a lubricating recess 86, and the bore 78 and holes 82 communicate between the end of the axle 38 and the lubricating recess 86 to provide a lubricant flow path. In the illustrated embodiment, the aperture 66 in the first end cap 34 is also part of the lubricant flow path.

The bearing 42 includes an outer race and an inner race 84 with ball bearings in-between the races. Other bearings may be used in place of the illustrated bearing 42. The axle 38 includes a bearing shoulder 90 against which the inner race 84 of the bearing 42 abuts to prevent the bearing 42 from sliding along the axle 38 into the lubricating recess 86.

The index base 46 includes a protruding portion 92, and is threaded onto the axle 38. The index base 46 is preferably threaded tightly against the bearing 42 such that the protruding portion 92 of the index base 46 abuts the inner race 84 of the bearing 42 to hold the inner race 84 against the bearing shoulder 90. When the index base 46 has been sufficiently tightened against the bearing 42, the bearing inner race 84 and the index base 46 are rotationally fixed with respect to the axle 38, but the outer race is free to rotate about the inner race 84 and axle 38. As illustrated in FIG. 3, the rest of the index base 46 does not contact the bearing 42, and permits the outer race of the bearing to rotate freely with respect to the inner race 84.

As illustrated, the bearing 42 defines one side of the lubricating recess 86. The bearing 42 is exposed to the lubricating recess 86 such that a selected lubricant, such as heavy grease or petroleum jelly, having a relatively high viscosity, may be injected into the lubricating recess 86 from the end of the axle 38 through the bore 78 and holes 82 and into the bearing 42. The heavy lubricant increases the friction in the bearing 42 such that the yo-yo 10 is more easily woken up. An example injector 94 is illustrated in phantom in FIG. 3. The injector 94 may be a syringe, the end of a tube, or any other device that provides lubricant under pressure. Preferably, the injector 94 is sized to fit at least partially into the aperture 66 in the first end cap 34. Lubricant may thus be applied to the bearing 42 through the aperture 66, bore 78, holes 82, and lubricating recess 86 while maintaining the string gap 74 setting.

Referring to FIGS. 3 and 4, the yo-yo 10 includes an indexing mechanism that includes the index base 46, the pin holder 50, the insertable members 54, and the biasing member 58. The insertable members 54 extend through apertures 96 in the pin holder 50, and extend into recesses or detents 98 in the index base 46 and against a wall 102 of the second side member 18. The detents 98 and wall 102 are complementary to the shape of the insertable members 54 such that a portion of the insertable members 54 may be inserted into the detents 98, but such that the insertable members 54 may be removed from one detent 98 and inserted into the next adjacent detent 98 upon relative rotation of the side members 14, 18.

Although the illustrated pin holder 50 includes three apertures 96 to accommodate three insertable members 54, more or fewer apertures 96 and insertable members 54 may be employed. The illustrated insertable members 54 are pins having conical ends, and the illustrated detents 98 and wall 102 define a partial cone to receive a portion of the conical ends of the insertable members 54. In this regard, the illustrated detents 98 and wall 102 are complimentary in shape to the ends of the illustrated insertable members 54. The insertable members 54 are supported for free sliding movement with respect to the pin holder 50 within the apertures 96 in the pin holder 50. In this regard, the insertable members 54 are supported for linear movement in axial directions aligned with the longitudinal axes of the insertable members 54. The insertable members 54 are preferably made of a wear-resistant material, such as hard steel. It is also possible that the insertable members 54 may take the form of round objects, such as ball bearings, or another shape.

The biasing member 58 is sandwiched between the second end cap 62 and the insertable members 54 such that the biasing member 58 provides a biasing force on the insertable members 54 toward the index base 46. The illustrated biasing member 58 is a compression spring, but other biasing members, such as elastomeric materials and leaf springs, are contemplated. The biasing member 58 provides sufficient normal force on the insertable members 54 that the pin holder 50 is substantially prevented from rotating with respect to the second side member 18. The biasing force drives the insertable members 54 against the index base 46.

The interface between the insertable members 54 and the detents 98 of the index base 46 resists relative rotation of the first and second side members 14, 18. Thus, the string gap 74 stays substantially constant unless the biasing force of the biasing member 58 is overcome to cause the insertable members 54 to ride up out of the detents 98 against the biasing force of the biasing member 58 and snap into the adjacent detents 98. The biasing force is preferably large enough to prevent the insertable members 54 from riding up out of the detents 98 during normal operation and handling of the yo-yo 10, but low enough to permit manual adjustment of the string gap 74 by intentionally manually rotating the side members 14, 18 with respect to each other.

In this regard, the indexing mechanism elastically or resiliently couples the pin holder 50 and the axle 38 to resist relative rotation between the pin holder 50 and axle 38. In other words, the indexing mechanism resiliently holds the side members 14, 18 at a selected string gap 74 setting. The indexing mechanism may be adapted to hold the side members 14, 18 at a string gap 74 setting without the use of the biasing member 58, in which case the indexing mechanism would not "resiliently hold" the side members 14, 18 at a string gap 74 setting. Such an indexing mechanism may include insertable members 54 that are manually movable into an out of interference with the detents 98 in the index base 46, rather than relying on the biasing force of the biasing member 58.

The indexing mechanism also permits indexed, incremental, or discrete string gaps 74, such that the string gap 74 may be releasably set at a plurality of selected widths. As used herein "indexed," "incremental," and "discrete," when used in reference to string gap settings, means movable from one setting to the next adjacent setting, but not in-between adjacent settings.

What is claimed is:

1. A yo-yo comprising:

first and second side members defining a string gap therebetween;

an axle extending between said side members;

a string interconnected with and windable around said axle; and an indexing mechanism including a detent mechanism for adjusting the string gap setting in discrete increments.

2. The yo-yo of claim 1, wherein said detent mechanism includes an index base having first and second detents, and wherein said indexing mechanism further includes an insertable member at least partially insertable into said first detent to releasably hold said first and second side members at a first string gap setting, said insertable member being removable from said first detent and insertable into said second detent to releasably hold said first and second side members at a second string gap setting.

3. The yo-yo of claim 2, wherein said insertable member is an elongated pin.

4. The yo-yo of claim 2, further comprising a biasing member biasing said insertable member into said first detent to resiliently hold said first and second side members at said first string gap setting, whereby said insertable member is movable from alignment with said first detent to alignment with said second detent against the biasing force of said biasing member, and whereby said biasing member biases said insertable member into said second detent to resiliently hold said first and second side members at said second string gap setting.

5. The yo-yo of claim 2, wherein said insertable member is slidable in an axial direction.

6. The yo-yo of claim 1, wherein said detent mechanism includes an index base having first and second sets of detents, and wherein said indexing mechanism further includes a plurality of insertable members and a pin holder having a plurality of apertures, said insertable members being disposed at least partially within said apertures and aligned with and at least partially inserted into said first set of detents to hold said side members at a first string gap setting, said insertable members being removable from said first set of detents and insertable into said second set of detents to releasably hold said first and second side members at a second string gap setting.

7. The yo-yo of claim 6, further comprising a biasing member biasing said insertable members into said first set of detents to resiliently hold said side members at said first string gap setting, whereby said insertable members are removable from said first set of detents against the biasing force of said biasing member, and movable into alignment with said second set of detents such that said biasing member biases said insertable members toward said second set of detents to resiliently hold said side members at said second string gap setting.

8. The yo-yo of claim 6, wherein said insertable members are elongated pins slidable within said apertures in an axial direction.

9. A yo-yo comprising:

first and second side members defining a string gap therebetween;

an axle having a longitudinal axis and extending between said side members, said axle including a bore extending substantially along said longitudinal axis through at least a portion of said axle and a hole in an outer surface of said axle communicating with said bore;

a bearing supported by said axle near said hole; and a string interconnected with and windable around said bearing;

whereby said bore and hole provide a lubricant flow path for lubricant injected into said bore for the lubrication of said bearing.

10. The yo-yo of claim 9, wherein said bore is positioned such that lubricant may be injected into said bore while the string gap is maintained at a selected string gap setting.

11. The yo-yo of clam 9, wherein a lubricating recess is defined between said bearing and one of said side members, and wherein said lubricant flow path communicates with said lubricating recess.

* * * * *